US012514352B2

(12) United States Patent
Hu

(10) Patent No.: US 12,514,352 B2
(45) Date of Patent: Jan. 6, 2026

(54) HAIR CURLER

(71) Applicant: Dongguan Fumeikang Electrical Technology Co., LTD., Guangdong (CN)

(72) Inventor: Haowen Hu, Guangdong (CN)

(73) Assignee: DONGGUAN FUMEIKANG ELECTRICAL TECHNOLOGY CO., LTD., Dongguan (CN)

( * ) Notice: Subject to any disclaimer, the term of this patent is extended or adjusted under 35 U.S.C. 154(b) by 126 days.

(21) Appl. No.: 18/670,995

(22) Filed: May 22, 2024

(65) Prior Publication Data

US 2024/0306783 A1 Sep. 19, 2024

(30) Foreign Application Priority Data

Dec. 6, 2023 (CN) ..... 202323324810.6

(51) Int. Cl.
*A45D 1/04* (2006.01)
*A45D 6/02* (2006.01)

(52) U.S. Cl.
CPC ..... *A45D 1/04* (2013.01); *A45D 6/02* (2013.01)

(58) Field of Classification Search
USPC ..... 132/238
See application file for complete search history.

(56) References Cited

U.S. PATENT DOCUMENTS

| | | | | |
|---|---|---|---|---|
| 4,233,999 | A * | 11/1980 | Thomas | A45D 1/04 132/238 |
| 8,237,089 | B2 * | 8/2012 | Legrain | A45D 1/28 132/234 |
| 9,504,301 | B1 | 11/2016 | Kennedy et al. | |
| 12,232,595 | B2 * | 2/2025 | Kim | A45D 24/007 |
| 2022/0142323 | A1 * | 5/2022 | Seo | A45D 1/28 |

FOREIGN PATENT DOCUMENTS

| | | | | |
|---|---|---|---|---|
| CN | 211483305 U | * | 9/2020 | |
| CN | 212382240 U | * | 1/2021 | |
| KR | 101310663 B1 | * | 9/2013 | A45D 1/04 |

* cited by examiner

*Primary Examiner* — Tatiana L Nobrega
(74) *Attorney, Agent, or Firm* — SHIMOKAJI IP

(57) ABSTRACT

A hair curler includes a handle, a hair roller, a hair clamp, and a driving mechanism. The hair roller is rotatably arranged on the handle, and the hair clamp is arranged on the hair roller. The driving mechanism includes a motor, an outer gear, and an inner gear. The motor is arranged inside the handle, the outer gear is arranged on the motor, one end of the inner gear is rotatably arranged at one end of the handle, and the other end is coaxially arranged with the hair roller and connected with the hair roller. The outer gear is located within an inner ring of the inner gear and meshes with teeth of the inner gear, and an output shaft of the motor is deflected from the central axis of the hair roller. The air curler has simple and compact structure, reasonable layout, and stable operation.

14 Claims, 18 Drawing Sheets

HAIR CURLER

FIELD OF THE INVENTION

The present application relates to a hair care device, and particularly to a hair curler.

BACKGROUND OF THE INVENTION

A hair curler is a hairdressing device that can curl and style hair. Existing hair curlers typically include a handle, a hair roller, a hair clamp, a driving mechanism, and a heater. The hair is clamped to the hair roller using the hair clamp, and then heated, and the hair roller is rotated by the driving mechanism to wind up the hair, thereby styling the hair. The driving mechanism generally includes a motor and a driving shaft, where the driving shaft extends into the hair roller and is connected to the hair roller to drive rotation. However, because the driving shaft is relatively slender, the area of contact with the hair roller is small, thereby making the hair roller prone to vibration during rotation, leading to unstable operation. In addition, the existing hair curler also requires a reducer to reduce the output speed at the output end of the motor, which occupies a large space inside the handle and makes the internal structure of the hair curler complex and the structure layout unreasonable.

SUMMARY OF THE INVENTION

The purpose of the present application is to provide a hair curler with a simple and compact structure, reasonable layout, and stable operation.

To achieve the above purpose, the present application provides a hair curler including a handle, a hair roller, a hair clamp, and a driving mechanism. The hair roller is rotatably arranged on the handle around a central axis thereof, and the hair clamp is arranged on the hair roller; the driving mechanism comprises a motor, an outer gear, and an inner gear, wherein the motor is arranged inside the handle; the outer gear is arranged on an output shaft of the motor; one end of the inner gear is rotatably arranged at one end of the handle, and the other end of the inner gear is coaxially arranged with the hair roller and is fixedly connected with the hair roller circumferentially; the outer gear is located within an inner ring of the inner gear and meshes with teeth of the inner gear; and an output shaft of the motor is deflected from the central axis of the hair roller.

Compared with the prior art, the hair curler of the present application includes the outer gear and the inner gear, the inner gear is rotatably arranged on the handle and coaxially fixedly connected inside the hair roller, and the outer gear is configured inside the inner gear to mesh with each other, so that the outer gear can be driven to rotate by the motor, thereby driving the inner gear and the hair roller to rotate. Since the end face of the inner gear can be relatively large, it can be firmly connected to the periphery of the end of the hair roller, so that the connection area between the hair roller and the inner gear is large, and the connection is firm, and the rotation is stable. Furthermore, by utilizing the cooperation between the inner gear and the outer gear, the speed can be reduced, and small occupation space inside the handle can be achieved, and the short output shaft of the motor does not need to extend into both ends of the hair roller, thus making the structure of the driving mechanism simpler and compact, thereby making the hair curler smaller and lighter.

In a preferable embodiment, the inner gear is provided with a connecting sleeve and a gear ring arranged on one side of the connecting sleeve, and an inner side of the gear ring is provided with teeth meshing with the outer gear; the hair curler further comprises a connecting base, one end of the connecting base is connected to the hair roller, and the other end of the connecting base is connected to the connecting sleeve.

In a preferable embodiment, a rear end face of the connecting base is provided with a first connecting hole around a central axis of the connecting base, and the connecting sleeve is provided with a first mounting hole penetrating through both ends, for allowing a screw to pass through the first mounting hole to connect with the first connecting hole.

In a preferable embodiment, the hair curler further includes electrical components and a control circuit board, wherein the electrical components are configured inside the hair roller, the control circuit board is configured inside the handle, the inner gear is provided an inner ring penetrating through both sides, the electrical components are electrically connected to the control circuit board via a conductive element, and the conductive element passes through the inner ring.

In a preferable embodiment, the hair curler further includes a sleeve and a rotating member, wherein one end of the sleeve passes through the inner ring of the inner gear and is fixedly connected to the handle, the rotating member is coaxially fixed in the connecting base, the sleeve is provided with a recess, and the rotating member is provided with a protrusion which is rotatably matched with the recess.

In a preferable embodiment, a first bearing is provided between the sleeve and the inner gear, and a second bearing is provided between the sleeve and the rotating member.

In a preferable embodiment, the hair curler further includes a conductive ring and a first conductive element, wherein the electrical components are electrically connected to the conductive ring, the first conductive element is electrically connected to the control circuit board; the conductive ring is coaxially sleeved on an outer side wall of the rotating member, and the first conductive element is arranged on an inner wall of the sleeve and slidably contacts with the conductive ring.

In a preferable embodiment, an outer side wall of the protrusion is in a stepped structure, and a diameter of the protrusion is gradually decreased, and the conductive ring is arranged on the stepped structure.

In a preferable embodiment, the hair curler further includes a conductive pillar and a second conductive element, wherein the conductive pillar is coaxially arranged inside the rotating member and one end of conductive pillar is extended into the sleeve, and the second conductive element is arranged inside the sleeve and slidably contacts with the conductive pillar.

In a preferable embodiment, the connecting base includes a cylindrical body, and a tube is extended from a front end of the cylindrical body for receiving the hair roller; a pivot base is extended from an outer side of the cylindrical body, and the hair clamp is pivoted on the pivot base.

In a preferable embodiment, the rotating member comprises a cone and the protrusion, the cone is extended outwardly along a central axis of the cone, the protrusion comprises several mounting units which are coaxially arranged and sleeved outside the central axis of the cone, and the conductive ring is provided between the cone and the mounting units and between adjacent mounting units.

In a preferable embodiment, an outer side surface of each of the mounting units is provided with an annular groove for accommodating the conductive ring, a rear end surface of each of the mounting units is provided with a positioning part, and a front end of each of the mounting units is installed with a mating part; when two adjacent mounting units are connected, the positioning part of one mounting unit is inserted into the other mounting unit and positioned by mating with the mating part.

In a preferable embodiment, the sleeve comprises an outer cylinder and an inner support, the inner support is arranged inside the outer cylinder, and the first conductive element is provided on the inner support.

In a preferable embodiment, the inner support is radially provided with positioning ribs, the positioning ribs are fixedly connected between each other through connecting rings, an inner wall of the outer cylinder is provided with positioning grooves, and the positioning ribs are configured in the positioning grooves.

In a preferable embodiment, the inner support is further provided with a positioning pillar, the first conductive element is provided with a positioning hole, and the positioning pillar is inserted through the positioning hole.

DETAILED DESCRIPTION OF ILLUSTRATED EMBODIMENTS

Figure 1:
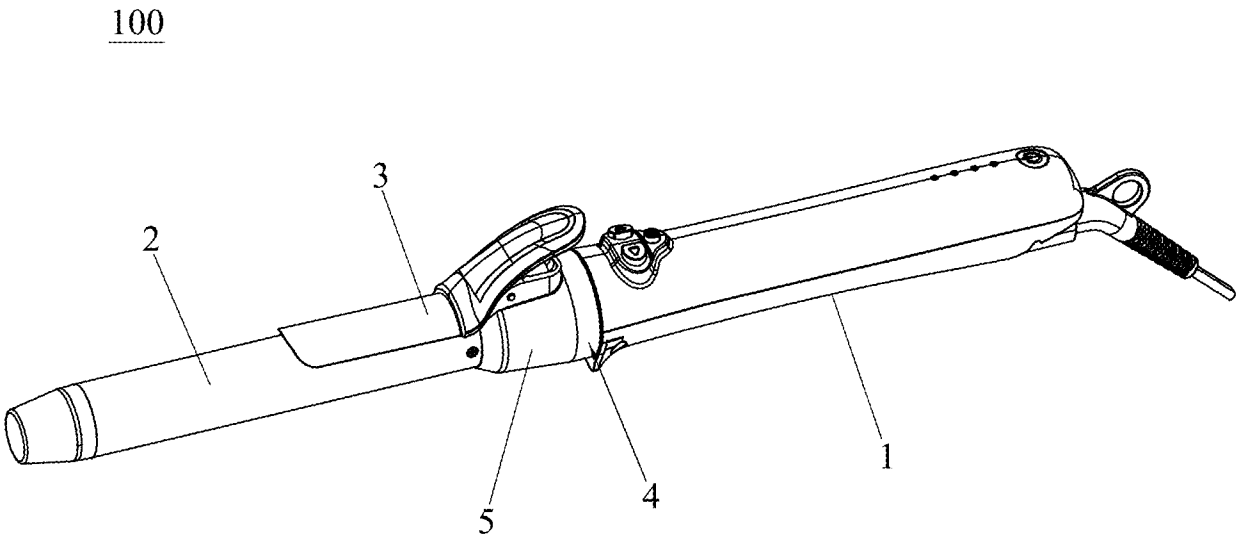
FIG. 1 is a perspective view of the hair curler according to the present application.

In order to explain the technical content, structural features, and achieved effects of the present application, the following detailed description is provided in combination with embodiments and accompanying drawings.

As shown in FIGS. 1 to 5, the hair curler 100 of the present application includes a handle 1, a hair roller 2, a hair clamp 3, and a driving mechanism 4. The hair roller 2 is rotatably arranged on the handle 1 around its central axis, and the hair clamp 3 is arranged on the hair roller 2. The hair roller 2 is configured to wind up the hair, and the hair clamp 3 is configured to hold and fix the hair on the hair roller 2. The driving mechanism 4 is arranged on the handle 1, and the output end of the driving mechanism 4 is connected to the hair roller 2 to drive the hair roller 2 to rotate. The driving mechanism 4 includes a motor 41, an outer gear 42, and an inner gear 43, with the motor 41 being arranged inside the handle 1. The outer gear 42 is fixedly arranged on the output shaft of the motor 41. One end of the inner gear 43 is rotatably arranged at one end of the handle 1, and the other end of the inner gear 43 is coaxially arranged with the hair roller 2 and fixedly connected with the hair roller 2 circumferentially. The outer gear 42 is located inside the inner ring of the inner gear 43 and meshes with the teeth 43*a* of the inner gear 43. The output shaft of the motor 41 is deflected from the central axis of the hair roller 2, that is, the output shaft of the motor 41 is misaligned with the central axis of the hair roller 2.

Figure 5:
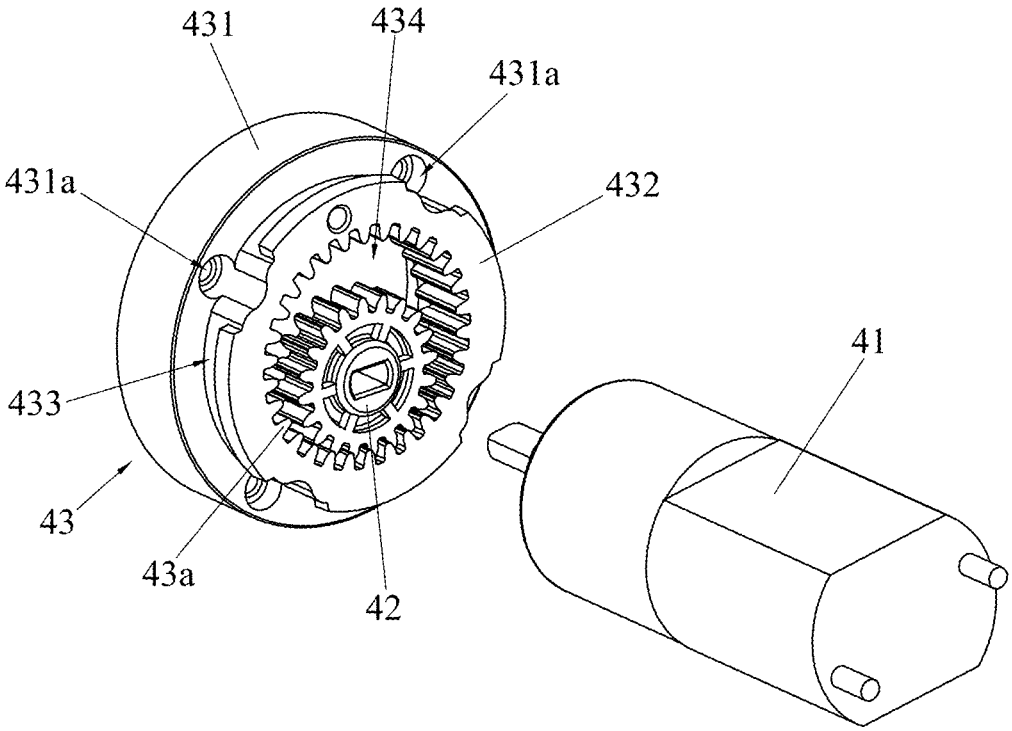
FIG. 5 is a structural view of the driving mechanism of the hair curler according to the present application.
Figure 6:
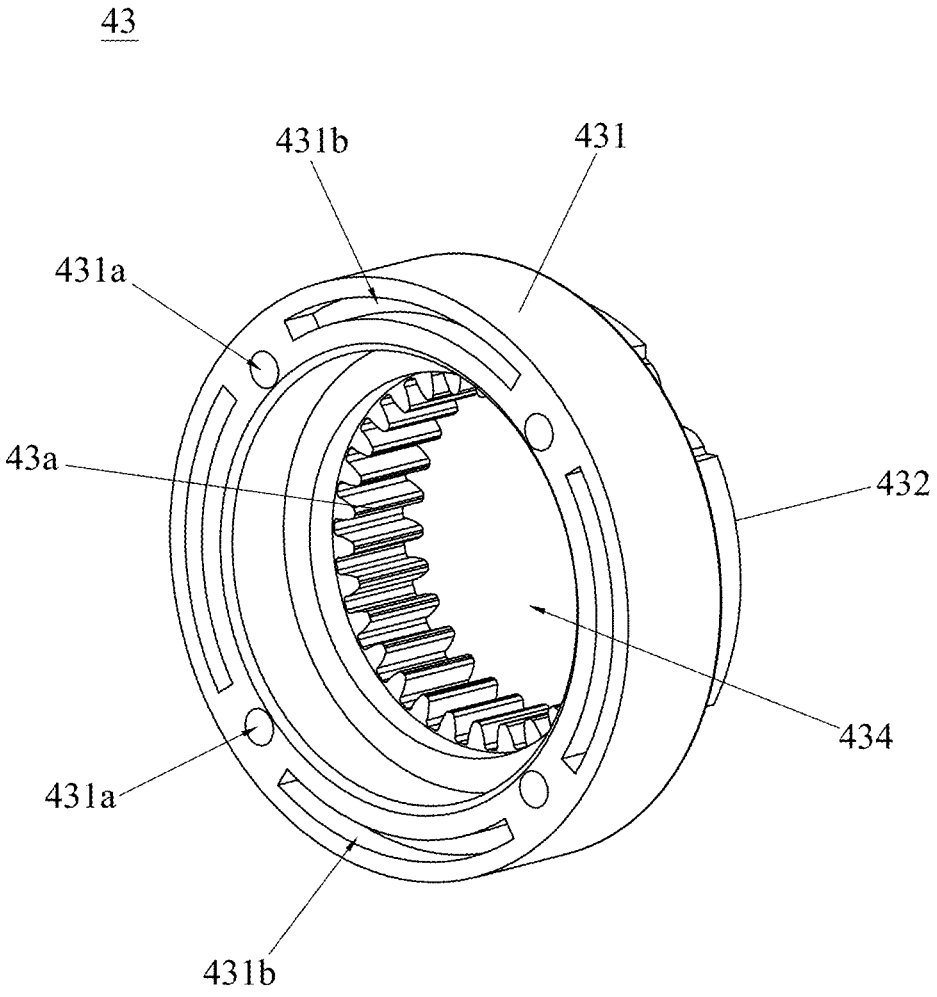
FIG. 6 is a structural view of the internal gear of the hair curler according to the present application.

Referring to FIGS. 5 and 6, specifically, the inner gear 43 has a connecting sleeve 431 and a gear ring 432 arranged on one side of the connecting sleeve 431. An annular locking groove 433 is provided between the gear ring 432 and the connecting sleeve 431. The inner side of the end of the handle 1 is provided with a snap ring 11, which is annular. The snap ring 11 is configured in the locking groove 433. The inner side of the gear ring 432 is radially provided with gear teeth meshing with the outer gear 42. The outer diameter of the outer gear 42 is smaller than the inner diameter of the gear ring 432, and the central axis of the outer gear 42 is deflected from the central axis of the gear ring 432.

Referring to FIGS. 3, 4, 7, and 8, the hair curler 100 further includes a connecting base 5. One end of the connecting base 5 is coaxially connected to the hair roller 2, and the other end of the connecting base 5 is connected to the connecting sleeve 431 of the inner gear 43. By setting the connecting base 5 and setting the connecting sleeve 431 at one end of the inner gear 43, the connecting base 5 is sleeved on the hair roller 2, and the connecting base 5 and the connecting sleeve 431 are fixedly connected circumferentially, so that the hair roller 2 is fixedly connected to the inner gear 43. Therefore, the inner gear 43 can be firmly and stably connected to the hair roller 2 and can drive the hair roller 2 with greater torque, making the operation of the hair roller 2 more stable. Specifically, the rear end surface of the connecting base 5 is provided with multiple first connection holes 5*a* around the central axis, and the connecting sleeve 431 is provided with first mounting holes 431*a* passing through both ends. In such a way, screws can pass through the first mounting holes 431*a* and connect to the first connection holes 5*a*, so that the connecting sleeve 431 is firmly and reliably connected to the connecting base 5. A locking rib 5*b* around the central axis is extended from the rear end surface of the connecting base 5, and a locking groove 431*b* around the central axis is provide at the end surface of the connecting sleeve 431. The locking rib 5*b* is configured to engage with the locking groove 431*b*, which can guide the cooperation of the connecting base 5 and the inner gear 43 during assembly, so that the connecting base 5 and the connecting sleeve 431 can be quickly and accurately aligned during connection, thereby improving the convenience of assembly.

Figure 7:
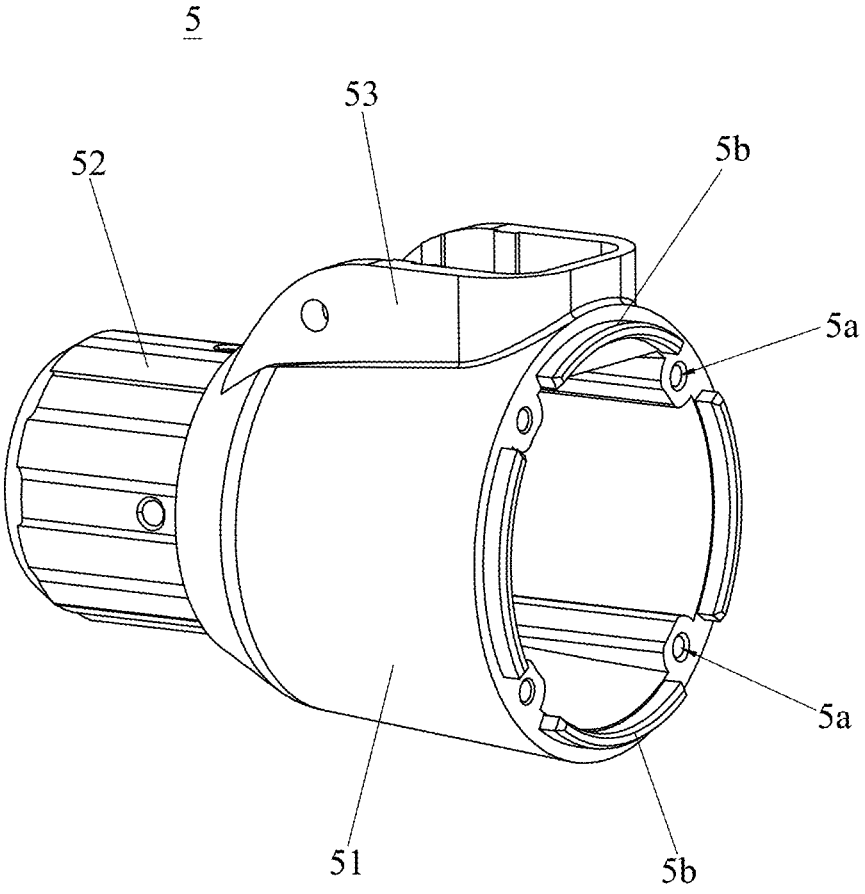
FIG. 7 is a perspective view of the connecting base of the hair curler according to the present application.
Figure 8:
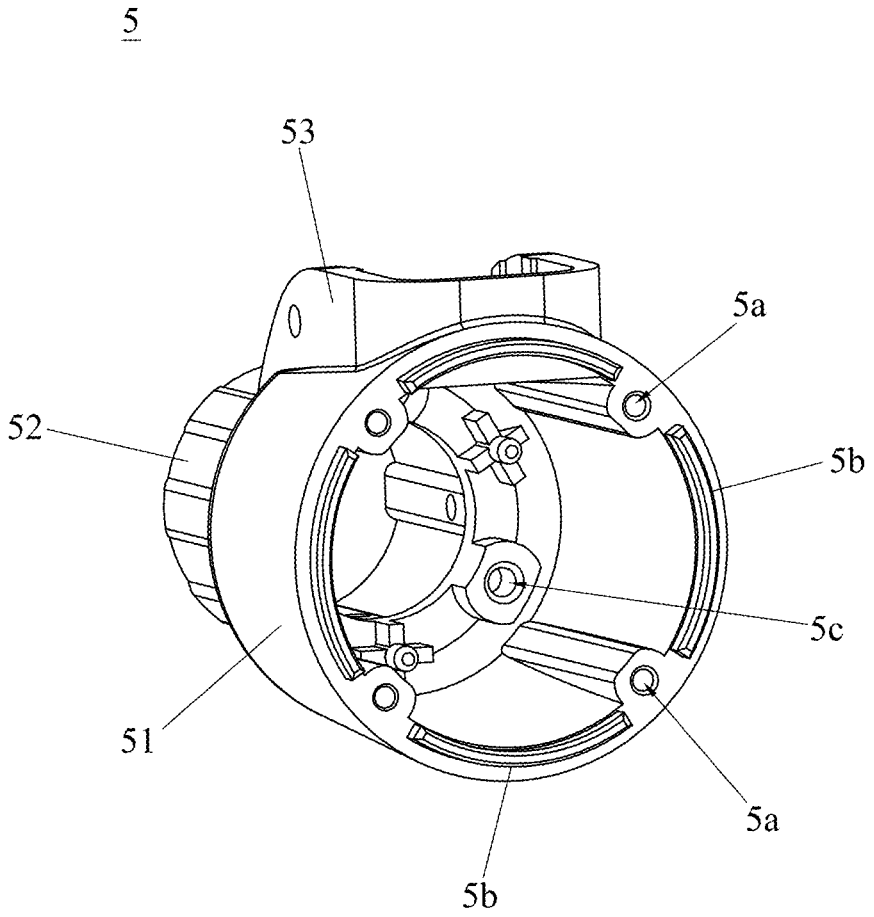
FIG. 8 is another perspective view view of the connecting base of the hair curler according to the present application.

As shown in FIGS. 7 and 8, the connecting base 5 includes a cylindrical body 51, and a tube 52 is extended from the front end of the cylindrical body 51 for connecting with the hair roller 2. The hair clamp 3 may be pivotally mounted on the connecting base 5. In this embodiment, the outer side of the cylindrical body 51 is extended outward to form a pivot base 53, on which the hair clamp 3 is pivotally mounted. By setting the cylindrical body 51 and the pivot base 53, the hair roller 2 and hair clamp 3 can be more easily installed on the connecting base 5, thereby effectively improving the convenience of assembly.

Figure 2:
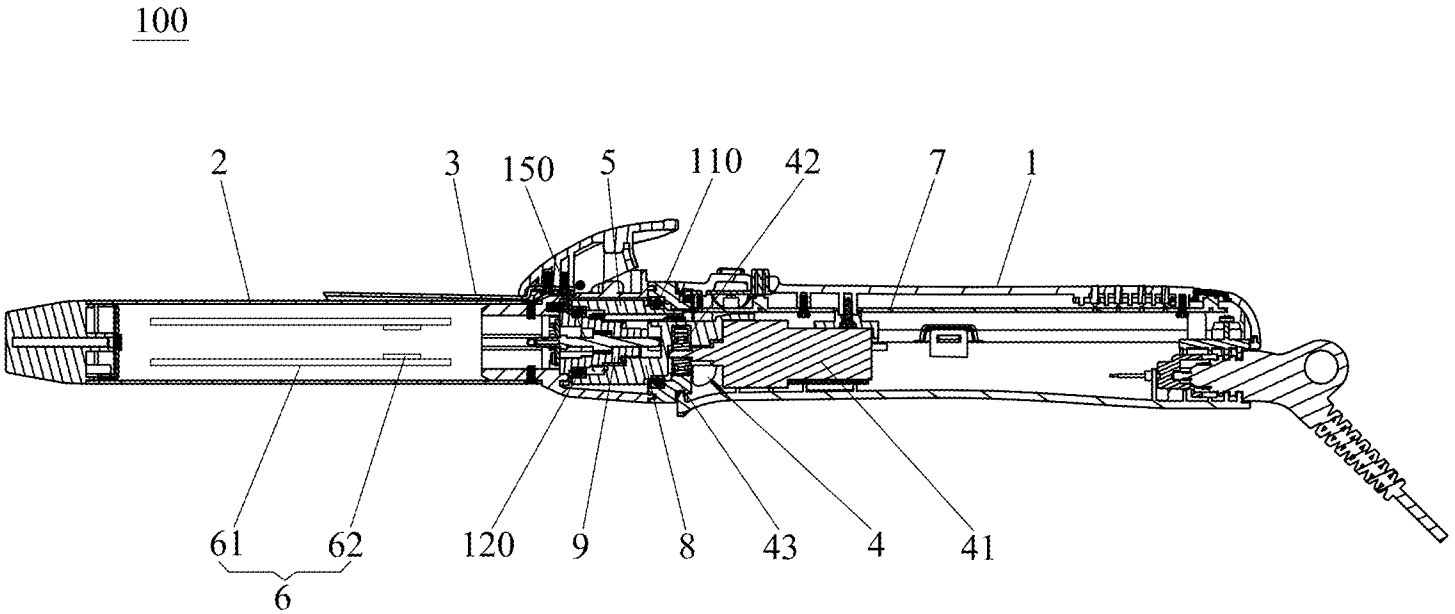
FIG. 2 is an axial sectional view of the hair curler according to the present application.
Figure 3:
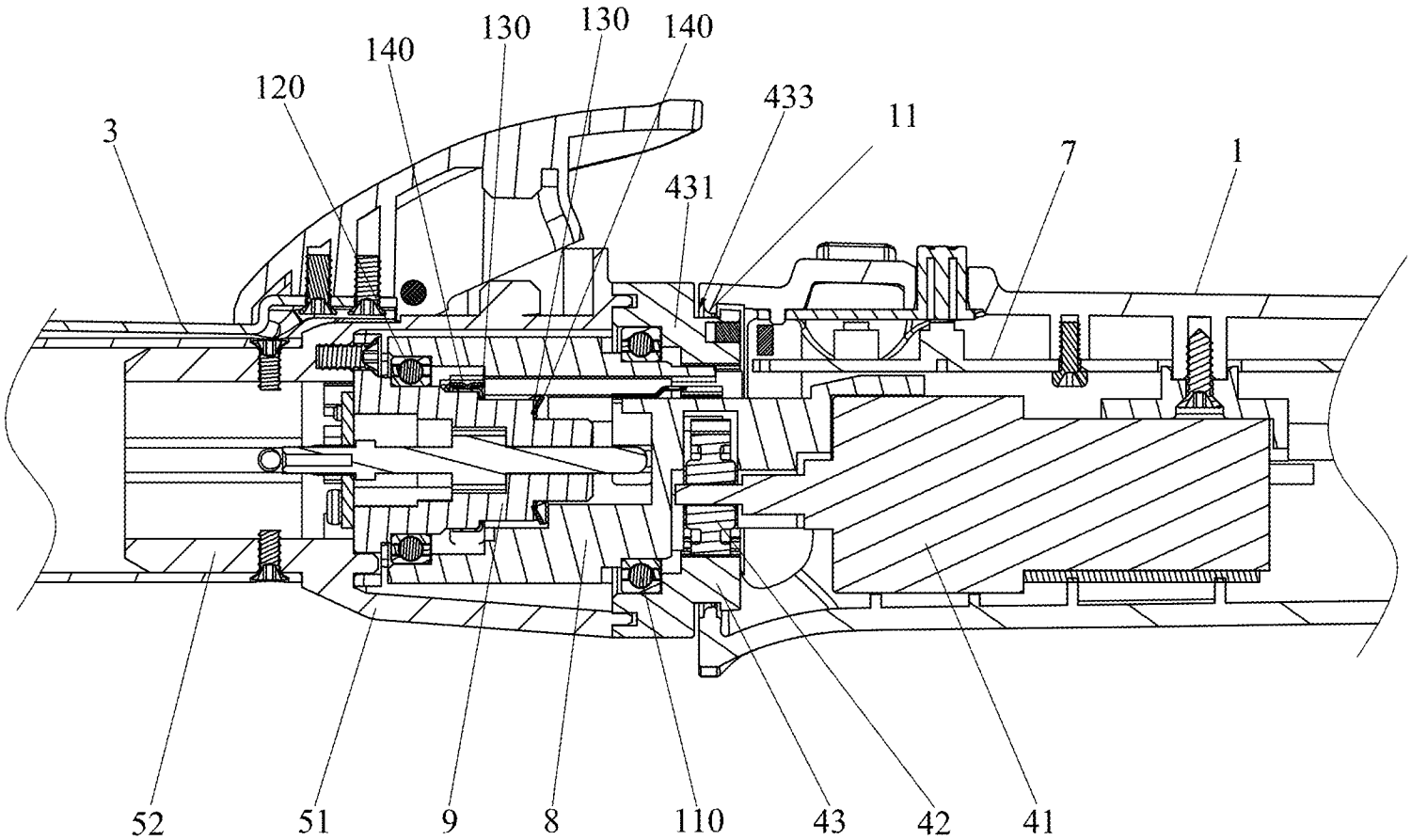
FIG. 3 is a partial enlarged view of FIG. 2.
Figure 4:
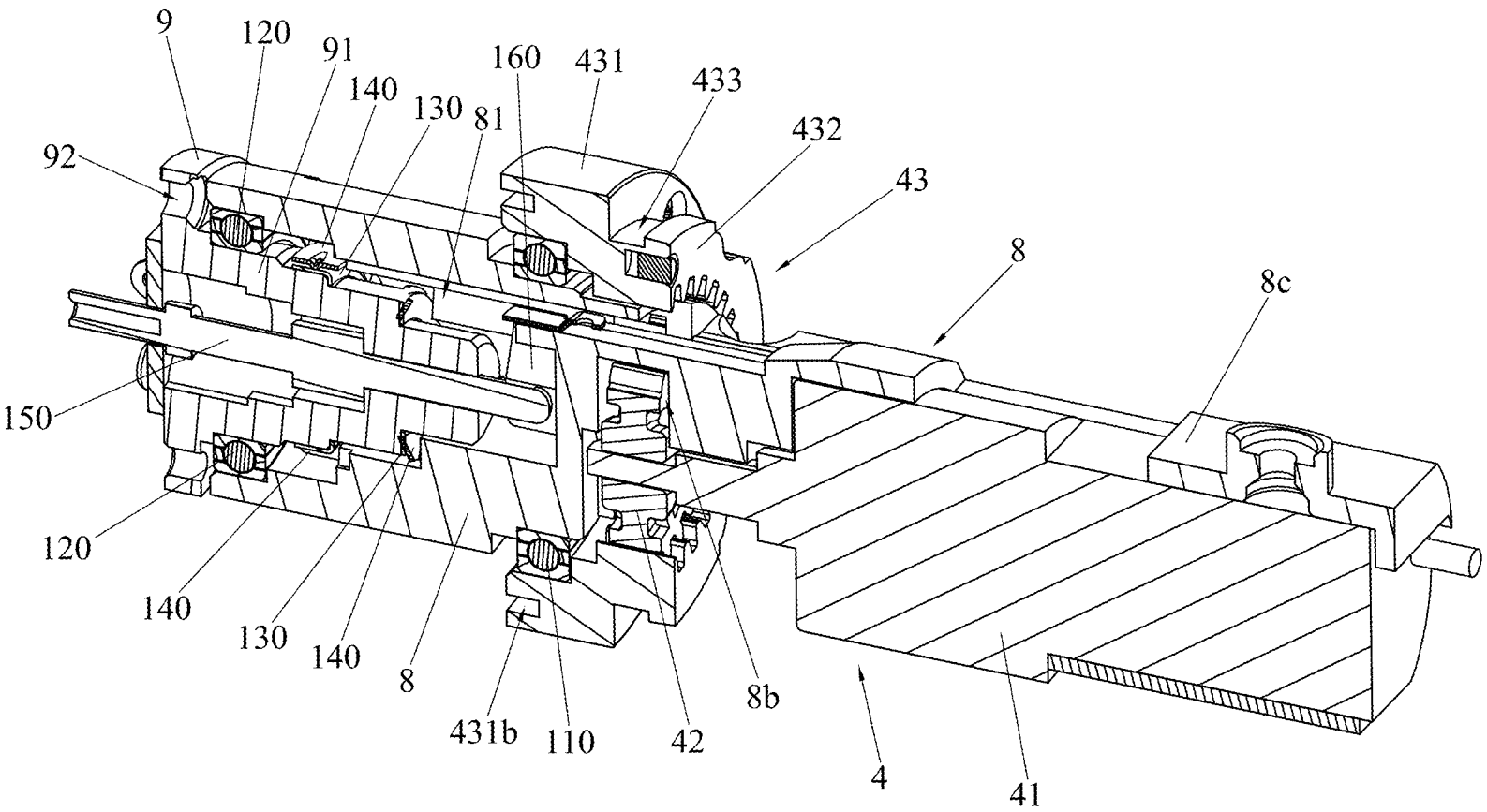
FIG. 4 is a sectional structural view of the driving mechanism, the sleeve, and the rotating member of the hair curler according to the present application.
Figure 9:
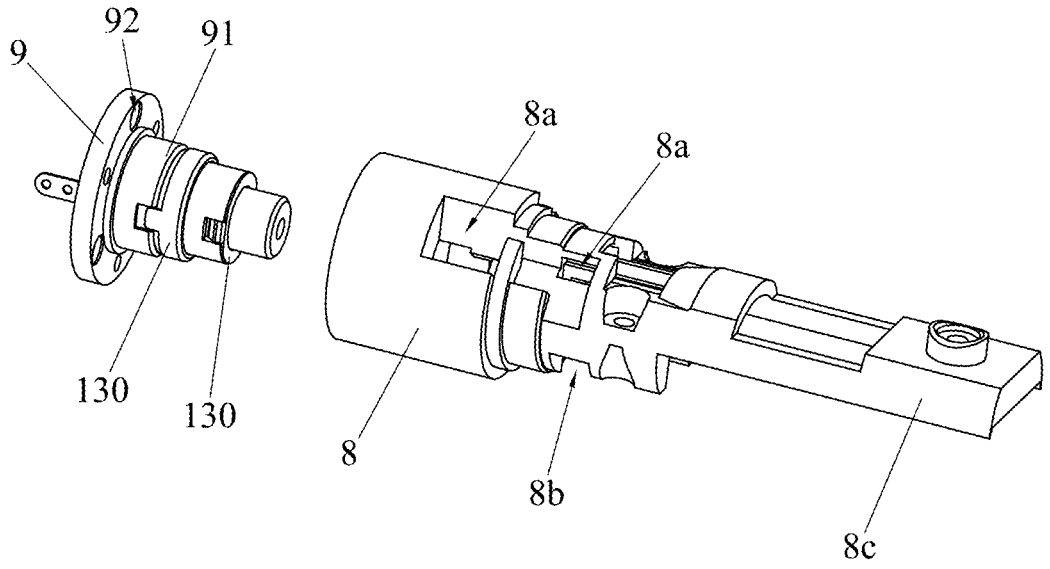
FIG. 9 is a structural view of the sleeve and rotating member of the hair curler according to the present application.

Referencing FIGS. 2, 4, and 9, the hair curler 100 further includes electrical components 6, a control circuit board 7, a sleeve 8, and a rotating member 9. The electrical components 6 are arranged inside the hair roller 2. The electrical components 6 in the present application include a heater 61 and a temperature sensor 62, wherein the heater 61 is configured to heat the hair roller 2, and the temperature sensor 62 is configured to detect the temperature of the hair roller 2. The control circuit board 7 is arranged inside the handle 1. The inner gear 43 is provided with an inner ring 434 that passes through both sides, with a certain gap between the outer gear 42 and the inner ring 434, for allowing the sleeve 8 to pass through. The electrical components 6 are electrically connected to the control circuit board 7 via conductive components. Specifically, the front end of the sleeve 8 is located inside the connecting base 5, and the other end of the sleeve 8 passes through the gap and extended into the handle 1 to fix with the handle 1. The conductive components pass through the inner ring 434 from the gap. The rotating member 9 is coaxially fixed inside the cylindrical body 51 of the connecting base 5, and one end of the rotating member 9 is provided with a second mounting hole 92, through which a screw passes to fix the rotating member 9 to the second connection hole 5*c* on the step surface inside the cylindrical body 51. A first bearing 110 is arranged between the sleeve 8 and the connecting sleeve 431 of the inner gear 43. The rotating member 9 is coaxially fixed inside the cylindrical body 51 of the connecting base 5, and a second bearing 120 is arranged between the sleeve 8 and the rotating member 9. In such an arrangement, the friction when the inner gear 43 and the hair roller 2 rotate is reduced, making the rotation smoother and more stable. The sleeve 8 is provided with a recess 81, which is a stepped structure, while the rotating member 9 is outwardly protruded with a protrusion 91, which is also in a stepped structure. The protrusion 91 may be inserted into the recess 81 and rotated cooperatively with the recess 81. By setting the sleeve 8 and rotating member 9, the sleeve 8 provides support for the rotation, thereby enabling the hair roller 2 to rotate more stably.

Figure 10:
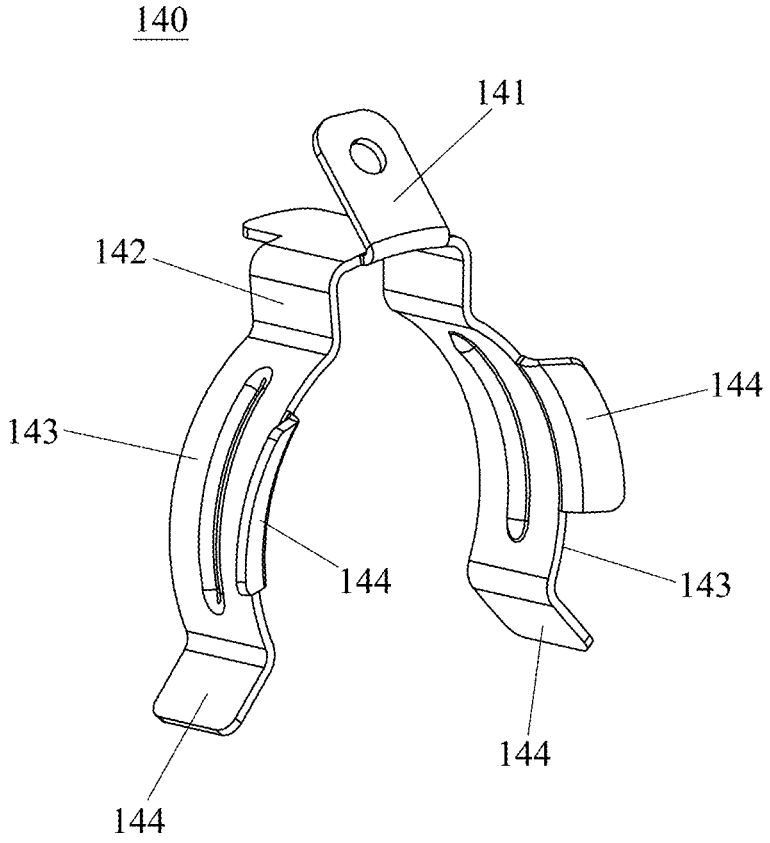
FIG. 10 is a structural view of the first conducting member of the hair curler according to the present application.
Figure 11:
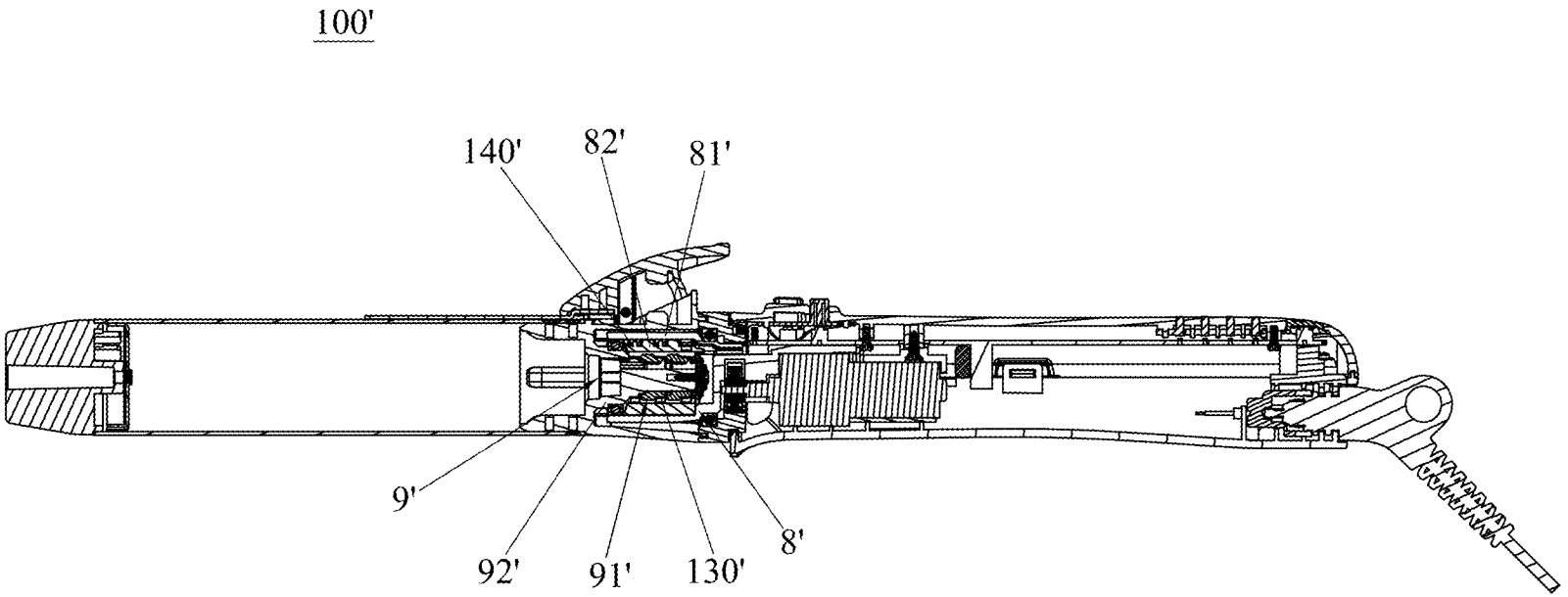
FIG. 11 is an axial sectional view of the hair curler according to another embodiment of the present application.
Figure 12:
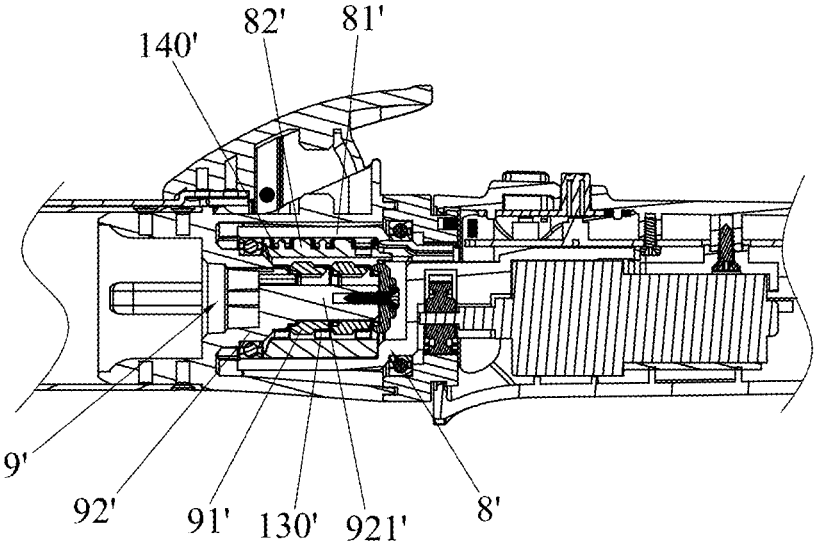
FIG. 12 is a partial enlarged view of FIG. 11.
Figure 13:
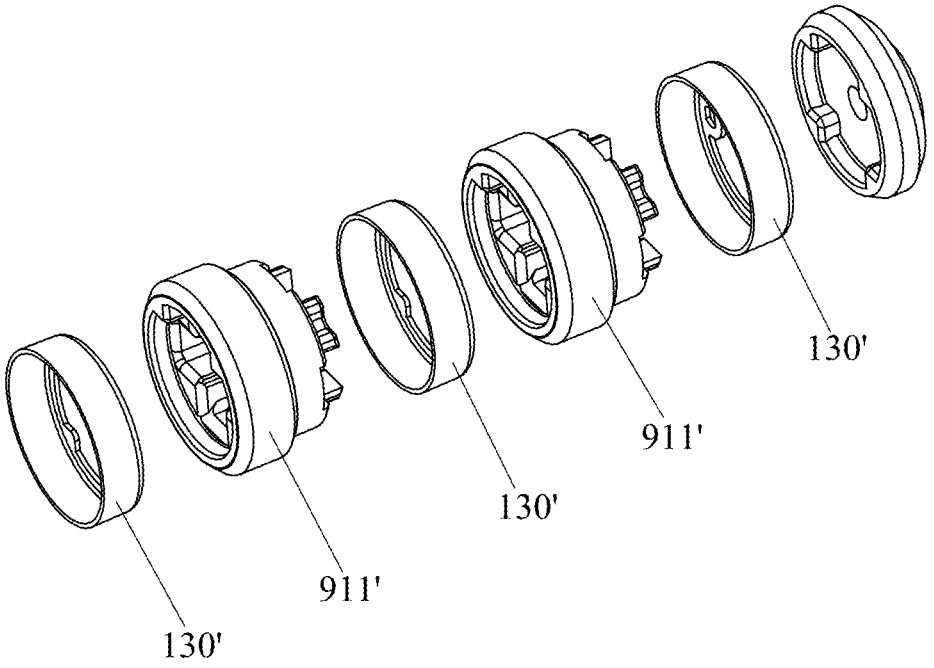
FIG. 13 is an exploded view of the protrusion of the hair curler according to another embodiment of the present application.
Figure 14:
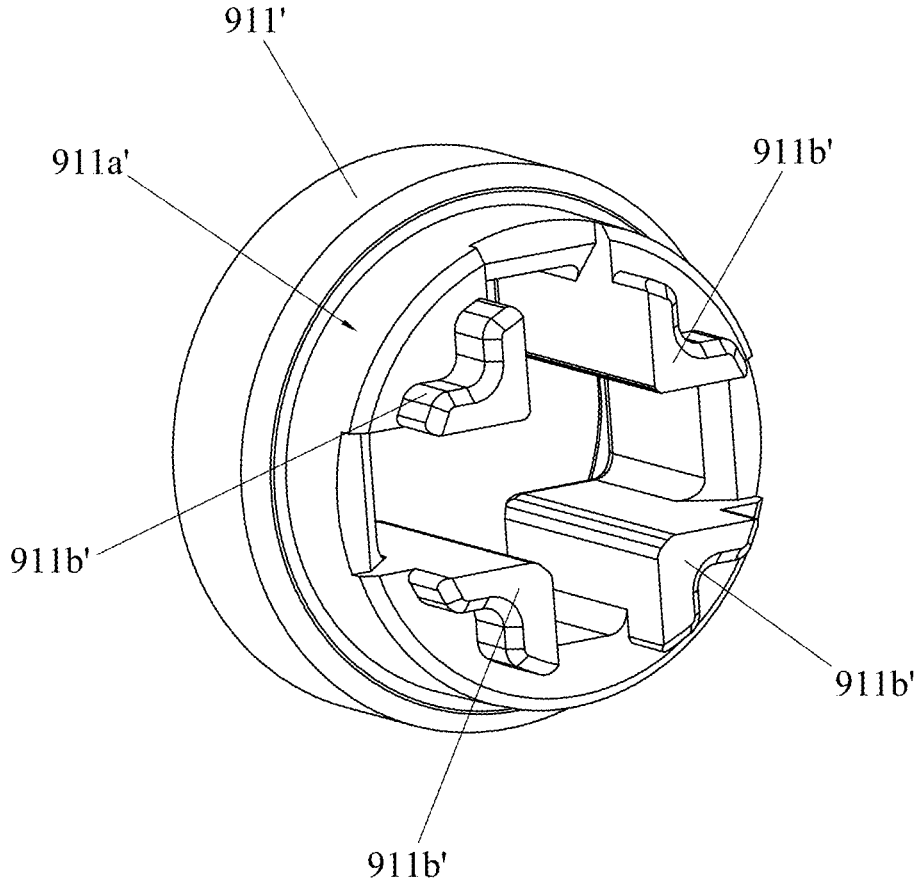
FIG. 14 is a structural view of the rear end of the installation unit of the hair curler according to another embodiment of the present application.
Figure 15:
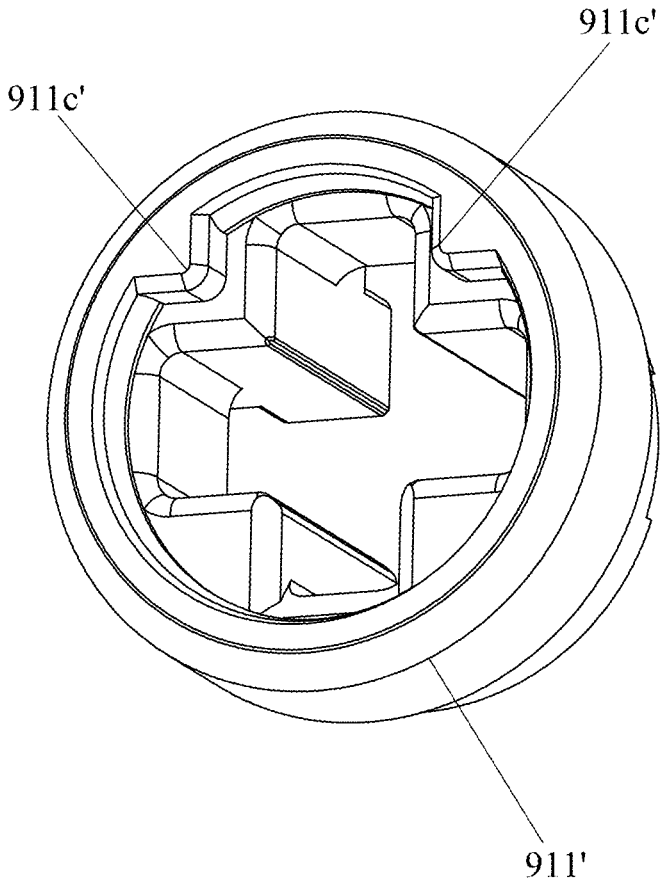
FIG. 15 is a structural view of the front end of the installation unit of the hair curler according to another embodiment of the present application.
Figure 16:
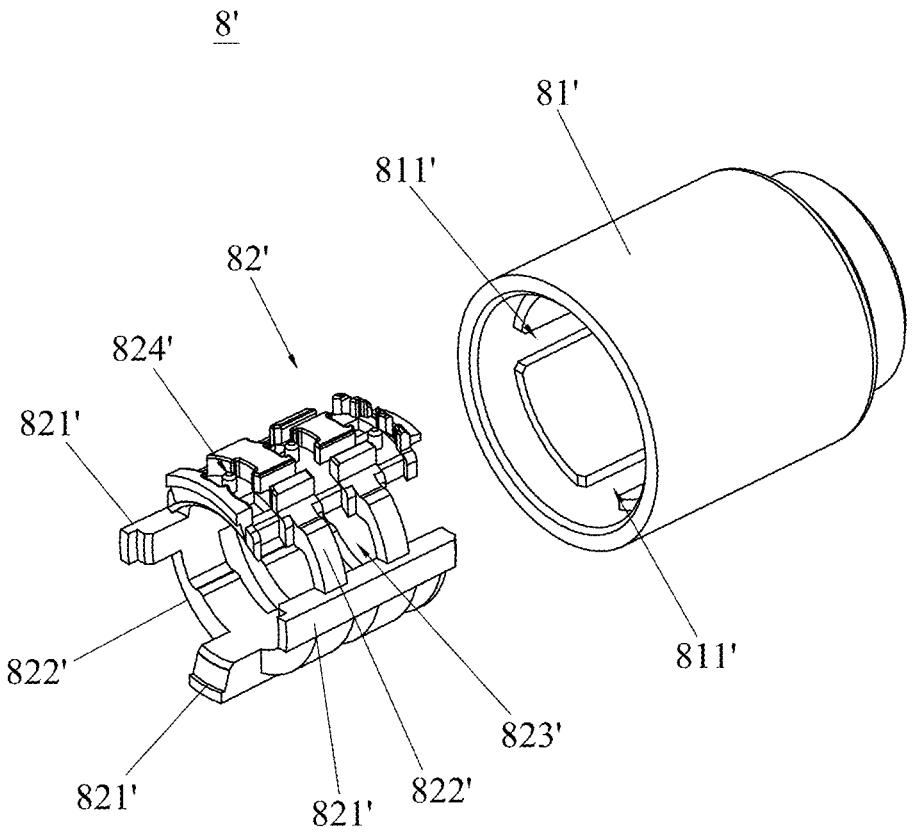
FIG. 16 is an exploded view of the inner support and the outer cylinder of the hair curler according to another embodiment of the present application.
Figure 17:
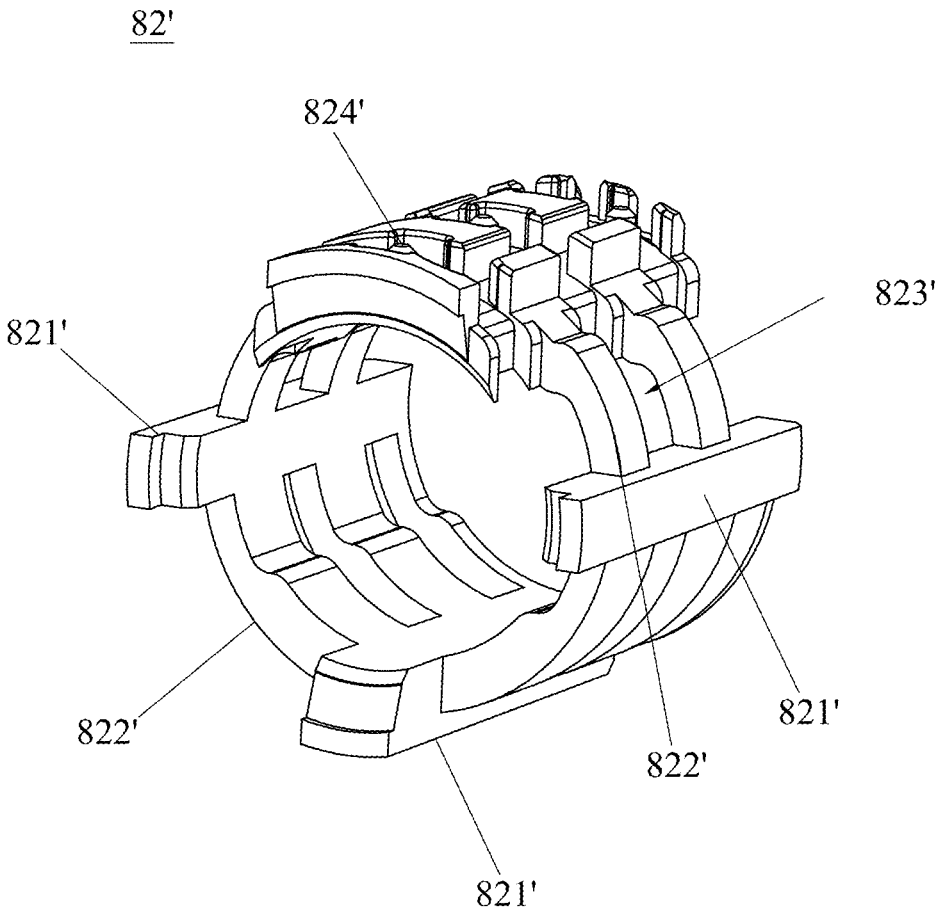
FIG. 17 is a structural view of the inner support of the hair curler according to another embodiment of the present application.
Figure 18:
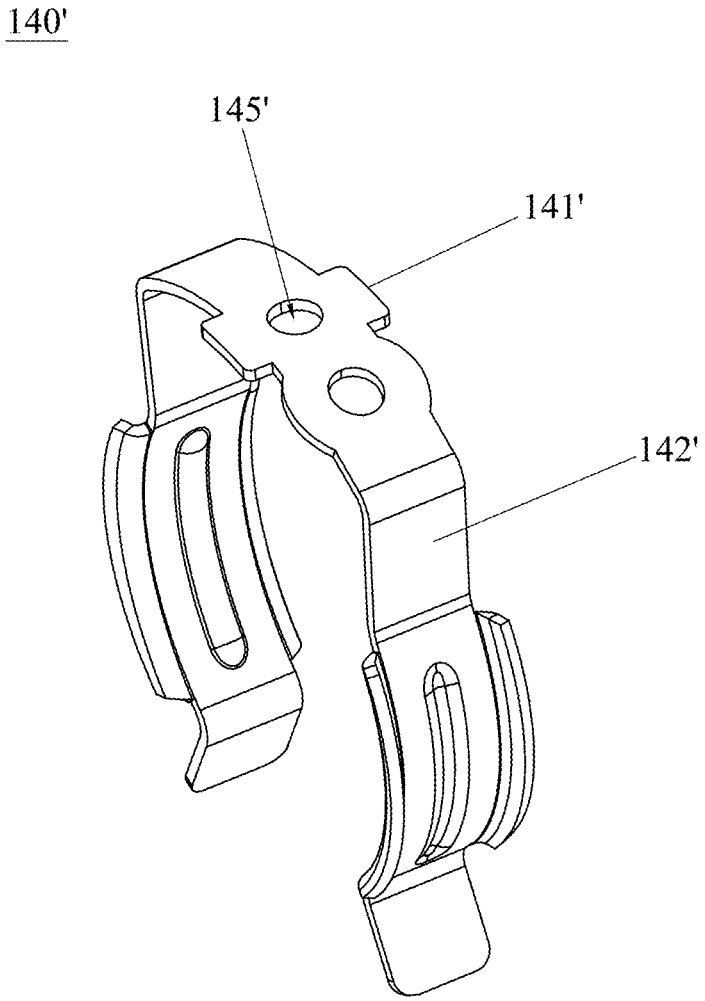
FIG. 18 is a structural view of the first conducting member of the hair curler according to another embodiment of the present application.

Referring to FIGS. 4, 9, and 10, the hair curler 100 further includes a pair of conductive rings 130 and a pair of first conductive elements 140. The electrical components 6 are electrically connected to the conductive rings 130, and the first conductive elements 140 are electrically connected to the control circuit board 7. The two conductive rings 130 are insulated from each other and coaxially sleeved on the outer side of the rotating member 9. Specifically, one of the conductive rings 130 is configured on the outer side wall of the stepped structure, and the other conductive ring 130 is configured on the step surface of the stepped structure. In such an arrangement, the two conductive rings 130 can be isolated from each other, avoiding short circuits. The two first conductive elements 140 are configured on the inner wall of the sleeve 8 and respectively slide in contact with the conductive rings 130. By sleeving the conductive rings 130 on the rotating member 9, the conductive rings 130 can be rotated with the rotating member 9. Furthermore, by setting the first conductive elements 140 outside the conductive rings 130, the first conductive elements 140 can slide in contact with the conductive rings 130, thus achieving electrical conductivity between them and connecting the electrical components 6 with the control circuit board 7, without interfering with the rotation of the hair roller 2, thereby ensuring the operation stability of the hair roller 2 and the electrical components 6. Specifically, the hair curler 100 further includes a conductive pillar 150 and a second conductive element 160. The conductive pillar 150 is coaxially arranged inside the rotating member 9 and extends into the sleeve 8 at one end. The second conductive element 160 is configured inside the sleeve 8 and slides in contact with the conductive pillar 150. The positive electrode of the heater 61 of the present application is connected to one of the conductive rings 130, and the first conductive element 140 in contact with the conductive ring 130 is electrically connected to the positive electrode power supply of the control circuit board 7. The negative electrode of the heater 61 is connected to the conductive pillar 150, and the second conductive element 160 is electrically connected to the negative electrode power supply of the control circuit board 7. The positive electrode of the temperature sensor 62 is connected to the other conductive ring 130, and the first conductive element 140 in contact with the conductive ring 130 is electrically connected to the control circuit board 7. The negative electrode of the temperature sensor 62 is connected to the conductive pillar 150, and the second conductive element 160 is electrically connected to the control circuit board 7. The negative electrode of the heater 61 shares the same conductive pillar 150 and second conductive element 160 with the negative electrode of the temperature sensor 62, which saves materials and further simplifies the structure.

As shown in FIG. 9, specifically, the outer wall of the sleeve 8 is provided with multiple through-holes 8*a* communicating with the recess 81, for allowing the first conductive element 140 and the second conductive element 160 to pass through, thereby facilitating the connection to the control circuit board 7 via wires or conductors extending into the handle 1. The lower portion of the middle part of the sleeve 8 is provided with a receiving chamber 8*b* for accommodating the outer gear, which is isolated from the first conductive element 140, the second conductive element 160, and the wires to prevent interference with the wires. A mounting base 8*c* is provided at one end of the sleeve 8 where is extended to the handle 1, for securing the motor 41, which can be fixed inside the handle 1 with screws.

Additionally, referring to FIG. 4 and FIG. 10, the first conductive element 140 located on the outer wall of the stepped structure of the rotating member 9 contacts with the outer wall of the corresponding conductive ring 130. The first conductive element 140 located on the surface of the stepped structure of the rotating member 9 contacts with the surface of the corresponding conductive ring 130. Except for the difference in shape between the first conductive element 140 located on the outer wall of the stepped structure of the rotating member 9 and the second conductive element 160 located at the end of the sleeve 8, their structures are basically the same. Taking the first conductive element 140 as an example, the first conductive element 140 includes a wiring portion 141, a connecting portion 142, and a pair of contact portions 143, which are integrally formed. The wiring portion 141 is configured in the middle of the connecting portion 142, and the two contact portions 143 are respectively configured at the opposite ends of the connecting portion 142. The contact portions 143 have certain elasticity and are arc-shaped to tightly wrap around the outer side of the component in contact with them, thereby ensuring stable electrical contact with the conductive ring 130. In the present embodiment, the contact portions 143 of the first conductive element 140 are wrapped around the outer side of the rotating member 9, while the contact portions 143 of the second conductive element 160 are wrapped around the end of the conductive pillar 150 near the sleeve 8. The ends and the front sides of the contact portions 143 each is extended with a guiding portion 144 to guide the contact portions 143. In the present embodiment, the first conductive element 140 located on the surface of the stepped structure of the rotating member 9 is annular in structure and has elastic protrusions on the surface to facilitate electrical connection with the conductive ring 130, the specific structure of which is not further detailed here. Optionally, the two conductive rings 130 and the two first conductive elements 140 may also have the same structure and be arranged on the outer wall or surface of the stepped structure of the rotating member, thereby achieving the same technical effect.

Based on the above descriptions and referring to the accompanying drawings, the working principle of the hair curler 100 of the present application is described in detail as follows.

When in use, firstly the hair is clamped on the hair roller 2 by means of the hair clamp 3, and then the motor 41 is started to drive the outer gear 42 to rotate, and in turn drive the inner gear 43 to rotate. Accordingly, the inner gear 43 drives the connecting base 5 to rotate, which in turn drives the hair roller 2 and the hair clamp 3 to rotate simultaneously. At the same time, the connecting base 5 drives the rotating member 9 to rotate inside the sleeve 8. Meanwhile, the control circuit board 7 controls the heater to heat the hair roller 2. Then, the hair curler 100 can curl and style the hair.

Compared with the prior art, the hair curler of the present application includes the outer gear 42 and the inner gear 43, the inner gear 43 is rotatably arranged on the handle 1 and coaxially fixedly connected inside the hair roller 2, and the outer gear 42 is configured inside the inner gear 43 to mesh with each other, so that the outer gear 42 can be driven to rotate by the motor 41, thereby driving the inner gear 43 and the hair roller 2 to rotate. Since the end face of the inner gear 43 can be relatively large, it can be firmly connected to the periphery of the end of the hair roller 2, so that the connection area between the hair roller 2 and the inner gear 43 is large, and the connection is firm, and the rotation is stable. Furthermore, by utilizing the cooperation between the inner gear 43 and the outer gear 42, the speed can be reduced, and small occupation space inside the handle 1 can be achieved, and the short output shaft of the motor 41 does not need to extend into both ends of the hair roller 2, thus making the structure of the driving mechanism 4 simpler and compact, thereby making the hair curler 100 smaller and lighter.

Referring to FIGS. 11 to 18, a hair curler according to another embodiment of t the present application is disclosed. The structure of the hair curler 100' in this embodiment is basically the same as that of the hair curler 100 in the above embodiment, with differences in the structure of the sleeve 8' and the rotating member 9'. Specifically, the rotating member 9' of this embodiment includes a cone 92' and a protrusion 91'. The cone 92' is extended outwardly with a central axis 921', and the protrusion 91' includes several independently separable mounting units 911' arranged coaxially and sleeved on the central axis 921'. One of the conductive rings 130' is arranged between the cone 92' and the mounting unit 911'. The outer side of the mounting unit 911' is provided with a annular groove **911*a*' for accommodating the conductive ring 130', and the other conductive rings 130' are arranged between adjacent mounting units 911' and located within the annular groove 911*a*'. The rear end face of the mounting unit 911' is surrounded by positioning parts 911*b*' which are protruding and have a bent rectangular cross-section. The front end of the mounting unit 911' is internally provided with mating parts 911*c*', and when adjacent mounting units 911' are connected, the positioning part 911*b*' of one mounting unit 911' is inserted into the other mounting unit 911' and matched with the mating part 911*c*'** for positioning.

Referring to FIGS. 11 to 18 again, the sleeve 8' includes an outer cylinder 81' and an inner support 82'. The inner support 82' is positioned within the outer cylinder 81', and the first conductive element 140' is arranged on the inner support 82'. The inner support 82' is circumferentially provided with positioning ribs 821' which are fixedly connected together by connecting rings 822'. The inner wall of the outer cylinder 81' is provided with positioning grooves 811', and the positioning ribs 821' are arranged within the positioning grooves 811'. A hollow structure 823' is formed between adjacent connecting rings 822' to allow the first conductive element 140' to extend into the interior of the inner support 82' and make electrical contact with the conductive ring 130'. The inner support 82' is further provided with positioning pillars 824'. In this embodiment, the structure of the first conductive element 140' is basically the same as that of the first conductive element 140 in the embodiment mentioned above. The difference is that in this embodiment, it only requires adaptive adjustments to the connecting portion 142' and the wiring portion 141' of the first conductive element 140', in order to install the first conductive element 140' onto the inner support 82'. Additionally, the first conductive element 140' is provided with positioning holes 145', through which the positioning pillars 824' pass to position the first conductive element 140' on the inner support 82'. In this embodiment, due to the combined structure of multiple installation units 911', the structures of the annular grooves **911*a*'** are the same. Therefore, the same type of conductive ring and conductive element can be used for conduction in this embodiment, which effectively simplifies the types of components and improves assembly convenience.

The working principle of the hair curler 100' in this embodiment is the same as that of the above-mentioned embodiment and will not be repeated here.

In this disclosure, specific embodiments are used to explain the principle and implementation of the present application. The above embodiments are only used to assist on understanding the method of the present application and the core concept. It should be pointed out that for persons ordinarily skilled in the art, without deviating from the principle of the present application, several improvements and modifications can also be made to the present application, which also fall within the scope of protection of the claims of the present application.

What is claimed is:

1. A hair curler comprising:

a handle;

a hair roller having a heating mechanism disposed therein, where the hair roller is rotatably coupled to the handle via a connecting base and the hair roller rotates about a central axis thereof;

a driving mechanism comprising: i) a motor arranged within the handle, ii) an outer gear having teeth on an outer periphery, and iii) an inner gear having a connecting sleeve and a gear ring which cooperatively define a central passage, wherein the gear ring has teeth arranged circumferentially along an inner surface adjacent the central passage and the gear ring is rotatably arranged at a proximal end of the handle, where the connecting sleeve is fixed to the connecting base such that the connecting sleeve is fixedly connected to and coaxially arranged with the hair roller;

an output shaft of the motor is offset from the central axis, and the outer gear is arranged on the output shaft and is disposed in the central passage of the inner gear such that the teeth of the outer gear mesh with the teeth of the inner gear;

a sleeve having one end disposed within the central passage of the inner gear and fixedly secured to the handle; and a rotating member disposed within the sleeve, where first and second conductive rings are sleeved over the rotating member in isolation from each other, and a pair of first conductive elements are provided on an inner wall of the sleeve, whereby the pair of first conductive elements slide in contact with the first and second conductive rings;

wherein the heating mechanism is electrically connected to one of the first and second conductive rings.

2. The hair curler according to claim 1, wherein one end of the connecting base is connected to the hair roller, and the other end of the connecting base is connected to the connecting sleeve.

3. The hair curler according to claim 2, wherein a rear end face of the connecting base is provided with a first connecting hole around the central axis of the connecting base, and the connecting sleeve is provided with a first mounting hole penetrating through both ends, for allowing a screw to pass through the first mounting hole to connect with the first connecting hole.

4. The hair curler according to claim 2, further comprising a control circuit board configured inside the handle heating mechanism is electrically connected to the control circuit board via the one of the first and second conductive rings.

5. The hair curler according to claim 4, wherein the rotating member is coaxially fixed in the connecting base, the sleeve is provided with a recess, and the rotating member is provided with a protrusion which is rotatably matched with the recess.

6. The hair curler according to claim 5, wherein a first bearing is provided between the sleeve and the inner gear, and a second bearing is provided between the sleeve and the rotating member.

7. The hair curler according to claim 5, wherein an outer side wall of the protrusion has a stepped structure such that a diameter of the protrusion is gradually decreased, and the first and second conductive rings are arranged on the stepped structure.

8. The hair curler according to claim 5, further comprising a conductive pillar and a second conductive element, wherein the conductive pillar is coaxially arranged inside the rotating member and one end of the conductive pillar is extended into the sleeve, and the second conductive element is arranged inside the sleeve and slidably contacts with the conductive pillar.

9. The hair curler according to claim 2, wherein the connecting base comprises a cylindrical body, and a tube is extended from a front end of the cylindrical body for receiving the hair roller; a pivot base is extended from an outer side of the cylindrical body, and a hair clamp is pivoted on the pivot base.

10. The hair curler according to claim 5, wherein the rotating member comprises a cone and the protrusion, the cone is extended outwardly along a central axis of the cone, the protrusion comprises several mounting units which are coaxially arranged and sleeved outside the central axis of the cone, the first conductive ring is provided between the cone and one of the mounting units and between adjacent mounting units and the second conductive ring is provided between the cone and another one of the mounting units and between adjacent mounting units.

11. The hair curler according to claim 5, wherein an outer side surface of each of the mounting units is provided with an annular groove for accommodating the corresponding first or second conductive ring, a rear end surface of each of the mounting units is provided with a positioning part, and a front end of each of the mounting units is installed with a mating part; when two adjacent mounting units are connected, the positioning part of one mounting unit is inserted into the other mounting unit and positioned by mating with the mating part.

12. The hair curler according to claim 10, wherein the sleeve comprises an outer cylinder and an inner support, the inner support is arranged inside the outer cylinder, and the pair of first conductive elements are is provided on the inner support.

13. The hair curler according to claim 12, wherein the inner support is radially provided with positioning ribs, the positioning ribs are fixedly connected between each other through connecting rings, an inner wall of the outer cylinder is provided with positioning grooves, and the positioning ribs are inserted in the positioning grooves.

14. The hair curler according to claim 13, wherein the inner support is further provided with a positioning pillar, at least one of the first conductive elements of the pair of first conductive elements is provided with a positioning hole, and the positioning pillar is inserted through the positioning hole.

* * * * *